US005552164A

United States Patent [19]

Kuipers et al.

[11] Patent Number: 5,552,164

[45] **Date of Patent: *Sep. 3, 1996**

[54] INFUSION PACKAGE

[75] Inventors: Jan Kuipers, Goudswaard, Netherlands; Craig S. McLean, Northampton, United Kingdom

[73] Assignee: Thomas J. Lipton, Co., Division of Conopco, Inc., Englewood, N.J.

[ * ] Notice: The term of this patent shall not extend beyond the expiration date of Pat. No. 5,552,165.

[21] Appl. No.: 321,191

[22] Filed: Oct. 11, 1994

[30] Foreign Application Priority Data

Oct. 12, 1993 [GB] United Kingdom ..... 9321034
Nov. 8, 1993 [GB] United Kingdom ..... 9322995

[51] Int. Cl.[6] ..... B65B 29/04

[52] U.S. Cl. ..... 426/80; 426/77; 426/83; 206/0.5; 53/134.2

[58] Field of Search ..... 426/77, 80, 83, 426/78, 79, 81, 82, 84; 53/134.2, 413; 206/0.5

[56] References Cited

U.S. PATENT DOCUMENTS

| | | | |
|---|---|---|---|
| 1,723,702 | 8/1929 | Mitchell | 426/81 |
| 1,775,347 | 9/1930 | Hirschhorn | 426/81 |
| 2,308,241 | 1/1943 | Hogaboom, Jr. | 426/80 |
| 2,335,159 | 11/1943 | Salfisberg | 426/83 X |
| 2,466,281 | 4/1949 | Shaw | 426/80 |
| 2,468,464 | 4/1949 | Salfisberg | 426/83 |
| 2,878,927 | 3/1959 | Haley | 426/80 |
| 2,881,910 | 4/1959 | Murphy | 426/80 |
| 2,986,269 | 5/1961 | Goldberg | 426/80 |
| 3,092,242 | 6/1963 | Imscher | 426/80 |
| 3,143,834 | 8/1964 | Imscher | 53/397 |
| 3,237,550 | 3/1966 | Christopher | 426/80 X |
| 3,396,032 | 8/1968 | McCrae et al. | 426/83 |
| 3,415,656 | 12/1968 | Lundgren | 426/80 X |
| 3,539,355 | 11/1970 | Kasakoff | 426/80 |
| 3,597,222 | 8/1971 | Kalemba | 426/83 X |
| 3,692,536 | 9/1972 | Fant | 426/77 X |
| 4,680,185 | 7/1987 | Illk | 426/83 |
| 5,366,741 | 11/1994 | Van Der Zon | 426/80 X |

FOREIGN PATENT DOCUMENTS

| | | |
|---|---|---|
| 118215 | 3/1944 | Australia . |
| 0448325 | 9/1991 | European Pat. Off. . |
| 1169388 | 12/1958 | France . |
| 1654971 | 4/1971 | Germany . |
| 8707075 | 12/1987 | Germany . |
| 3826911 | 2/1990 | Germany . |
| 2094267 | 9/1982 | United Kingdom . |
| 2151214 | 7/1985 | United Kingdom . |
| 2201934 | 9/1988 | United Kingdom . |
| WO91/13580 | 9/1991 | WIPO . |
| WO92/06903 | 4/1992 | WIPO . |
| WO93/19997 | 10/1993 | WIPO . |

*Primary Examiner*—Steven Weinstein
*Assistant Examiner*—Milton I. Cano
*Attorney, Agent, or Firm*—James J. Farrell

[57] ABSTRACT

A package containing a flowable infusible material which has a drawstring that passes out of the interior of the package via a first exit point and a second exit point and means which constrains said drawstring adjacent at least two sides. The arrangement is such that pulling the ends of the drawstring in substantially opposite directions causes the drawstring to move relative to the sides it engages thus allowing the package to collapse. Preferred embodiments of the package are rectangular, square or circular in shape.

10 Claims, 2 Drawing Sheets

INFUSION PACKAGE

FIELD OF THE INVENTION

This invention relates to packages containing a flowable material, particularly but not exclusively an infusible material such as tea or coffee, wherein the package has means for applying pressure on the contents of the packages to express liquid from the package after infusion.

BACKGROUND OF THE INVENTION

With the exception of water, tea is the most widely consumed of all beverages. In fact, the worldwide per capita consumption has been estimated at 0.1 liter per day.

In Western countries consumers tea is generally sold in bags which are placed in hot water and allowed to stew but discarded prior to drinking the tea. These bags come in many shapes and forms but which generally when removed after infusion contain a significant volume of liquid. In addition to the aesthetically unpleasant nature of a soggy tea bag there is a real risk that as the bag is removed from the cup for disposal some of the liquid remaining in the bag will drip onto and even stain the user's clothing or the table linen.

Attempts have been made to overcome or at least alleviate this problem by providing the bags with means for squeezing or wringing at least some of the liquid from the bags after use.

For example U.S. Pat. Nos. 3,539,355, 3,237,550, 2,881,910, 2,878,927 and 2,466,281 discloses infusion bags having drawstrings that are threaded through holes in the walls of the bag. However, dry infusible material can leak out of the bags prior to use, the holes weaken the structure of the bags thus encouraging them to tear and release their contents, and liquid can leak through the holes during squeezing action.

WO 91/13580 discloses analogous examples in which the drawstring may be retained at desired locations by staples driven through the walls of the bag. This similarly creates leakage paths and local weaknesses at regions where the drawstring tension is likely to be applied the bag.

Further examples of squeezable bags include U.S. Pat. No. 3,415,656, WO 92/06903 and WO 93/19997 which have envelopes formed by two rectangular layers of sheet material that are heat sealed together around their edges. A loop of thread is held in the bag by being trapped in the heat sealed margins at least at one region of those margins remote from one end of the bag where the ends of the loop emerge through the heat sealed margin at that end. This arrangement introduces another potential problem in that the heat seal where the thread is trapped is placed under stress when the bag is contracted and if it fails the bag is opened. Since this is likely to occur at the lower end of the bag, the solid contents would be spilled immediately. It is also noted that these earlier proposals do not suggest how the infusion packages can be economically produced.

OBJECT OF THE INVENTION

It is an object of the present invention to provide a squeezable infusion package that overcomes at least some of the deficiencies of the prior art, or at least provides the consumer with an effective alternative.

DEFINITION OF THE INVENTION

According to the present invention there is provided a package containing a flowable infusible material which is defined by at least two panels of a porous material and at least three sides, said package having a drawstring that passes out of the interior of the package via a first exit point and a second exit point and means which constrains said drawstring adjacent at least two sides, the arrangement being such that pulling the ends of the drawstring in substantially opposite directions causes the drawstring to move relative to the sides it engages thus allowing the package to collapse.

Preferably the package is rectangular or square but be differently shaped eg. triangular, tetrahedral, square, cubic, round or elliptical.

DESCRIPTION OF THE INVENTION

The invention will now be described in detail with reference to the schematic drawings that accompany this specification by way of non-limiting preferred embodiments.

Figure 1:
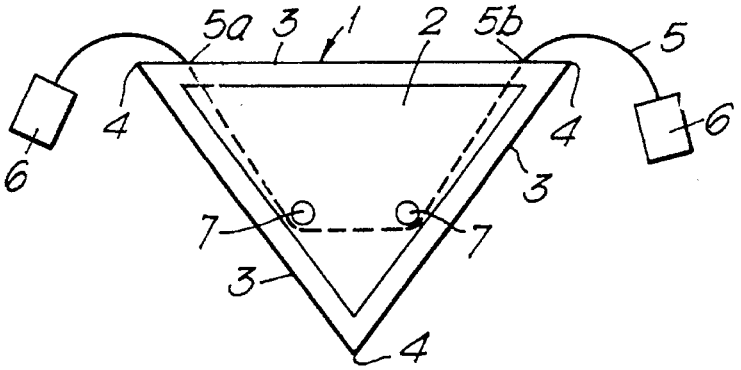
FIG. 1 illustrates a triangular bag of the present invention wherein the drawstring is slidably constrained adjacent two sides of the package.
Figure 8:
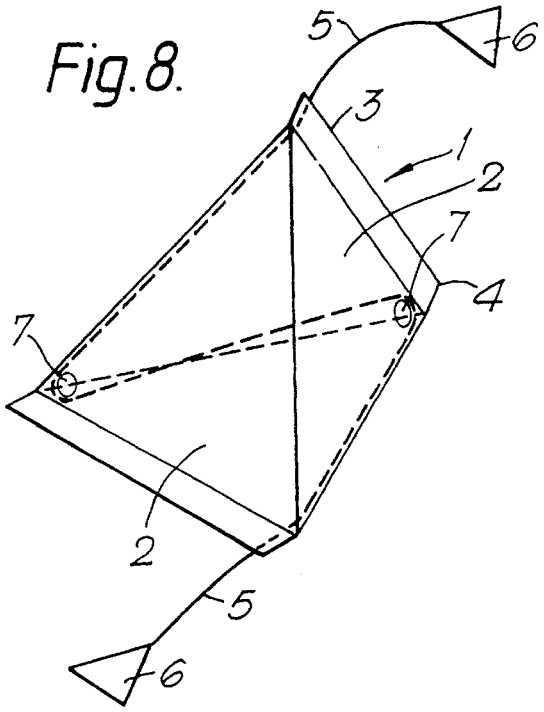
FIG. 8 illustrates a tetrahedral bag of the present invention wherein the drawstring is immovably fixed adjacent two vertices and slidably constrained alongside substantially the entire length of each of two sides of the package.
Figure 9:
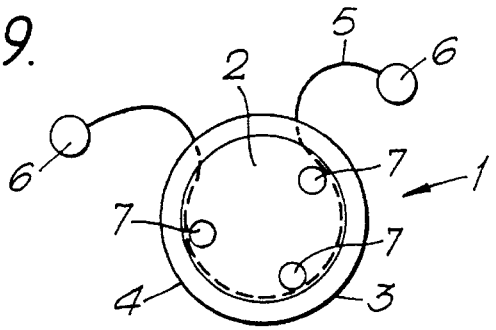
FIG. 9 illustrates a round bag of the present invention wherein the drawstring is slidably constrained adjacent portions of the inner perimeter of the bag by three spot welds.

The package of the invention can take many forms. For example the bag 1 may be triangular, rectangular, square, tetrahedral, cubic, round, elliptical, spherical or any other geometric shape. The shape can be defined in terms of the number of panels 2, sides 3 and vertices 4. For example the bag shown in FIG. 1 has two panels, 3 sides and 3 vertices while the bag shown in FIG. 8 has four panels, six sides and four vertices. The round bag shown in FIG. 9 has two panels, but an infinite number of sides.

The package preferably contains tea, be that black, green, oolong, maté or rooibos etc, but other infusible substances such as coffee or cocoa could be used in addition to flavourings, colouring agents, creamers, whiteners, herbs, herbal preparations, vitamin supplements and the like. Tea or coffee might also be blended with instant or powdered tea or coffee.

The bag 1 has a drawstring 5 which may be a cotton or plastics strip or thread or the like. The drawstring is at least partially contained with in the interior bag and emerges from the interior of the bag at exit points 5*a* and 5*b*.

Figure 3:
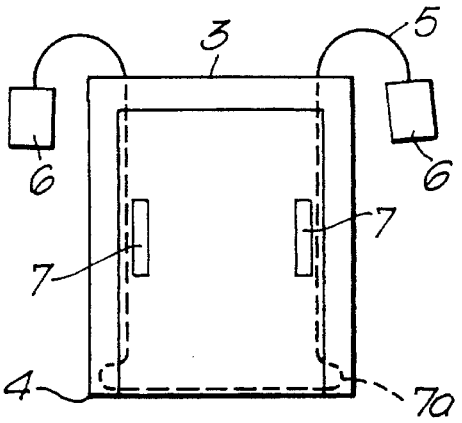
FIG. 3 illustrates a rectangular bag of the present invention wherein the drawstring is slidably constrained near the midpoint of two opposing sides by line welds and also permanently fixed within the seals at the base of the bag.
Figure 4:
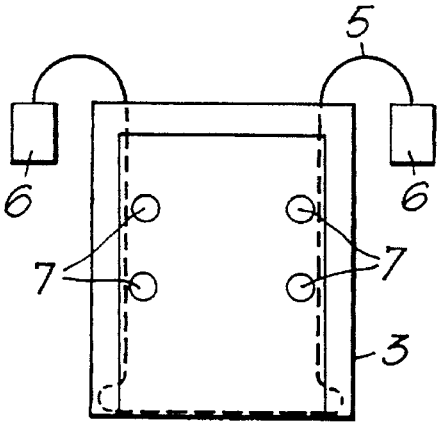
FIG. 4 illustrates a rectangular bag of the present invention that is similar to that shown in FIG. 3, except two spot welds take the place of each of the line welds.
Figure 5:
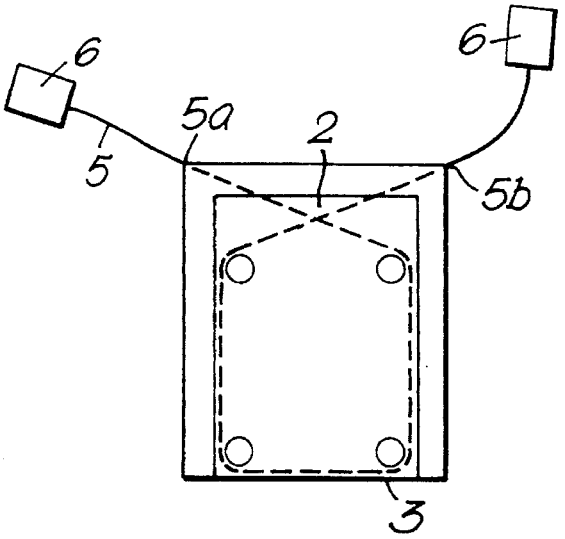
FIG. 5 illustrates a rectangular bag of the present invention that is similar to that shown in FIG. 2, the difference being that the drawstring extends from each exit point to the closest spot weld on the opposite side thereby causing the drawstring to cross-over itself.
Figure 6:
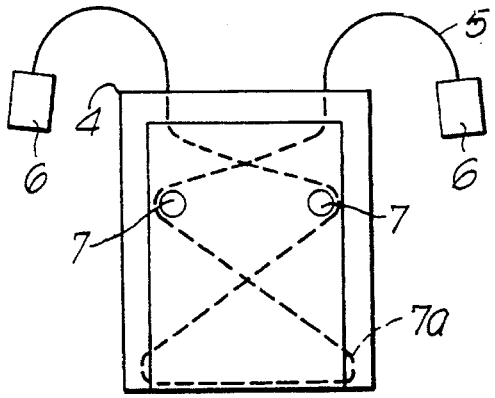
FIG. 6 illustrates a rectangular bag of the present invention wherein the drawstring is slidably constrained adjacent the midpoint of two opposing sides by spot welds and also permanently fixed within the seals at the base of the bag. The drawstring is arranged so that it crosses over itself on either side of the two spot welds.
Figure 7:
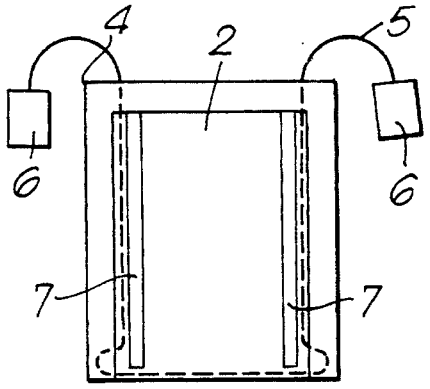
FIG. 7 illustrates a rectangular bag of the present invention that is similar to that shown in FIG. 3, except the line welds extend almost entirely from the top of the base of the bag.

A tag 6 may be attached at one but preferably both ends of the drawstring by art-known means such as gluing or stapling. The tag can be of any shape such as rectangular, square, triangular or round and may take the form of part of a splittable tag such as is shown in FIG. 3.

The panels 2 are composed of a porous material such as paper, tissue, polypropylene webbing or any other material that is commonly used to make infusion packages. These panels are sealed (preferably heat sealed) or folded and then sealed together to yield the package. Folding a single sheet of porous material can be advantageous as this maximises the rate of infusion through the side formed between the panels.

The drawstring 5 is constrained to at least two sides at suitably placed constraining points or regions 7 within the interior of the bag. The constraining is such that the drawstring can move relative to the side by a sliding action or the like. Such a construction is important as it may encourage the bag to be collapsible in two or more dimensions.

For example when the drawstring is anchored (i.e. immovably fixed) to the base of the bag pulling the ends of the drawstring in opposite directions will cause the bag to contract vertically but not horizontally. However when the drawstring is only slidably constrained adjacent the base of the bag, the bag can contract in both vertical and horizontal directions. This therefore allows the consumer to exert more pressure on the total volume of the soaked infusible material and therefore squeeze more liquid out of the bag. This is particularly apparent when the arrangement of the drawstring is such that it traces around a number of constraining points which act as fulcrums or the drawstring crosses over itself. Examples of these are illustrated in FIGS. 5, 6, 8 and 9. And indeed in the case of the bag shown in FIG. 8 pulling the drawstrings causes the bag to contract in all three dimensions.

Providing for the drawstring to slidably engage the sides of the bag rather than be anchored or fixed thereto can also allow the consumer to apply more squeezing force without damaging the bag.

Figure 2:
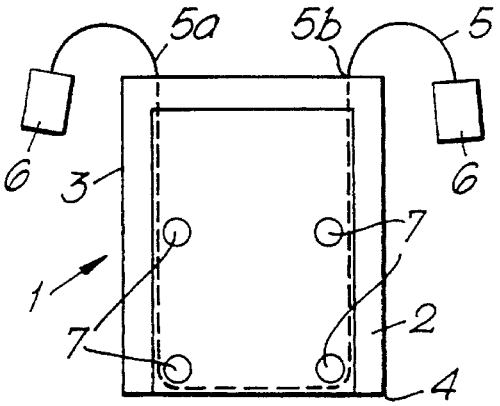
FIG. 2 illustrates a rectangular bag of the present invention wherein the drawstring is slidably constrained adjacent two opposing sides by spot welds at two locations on each side.

The squeezing action can also be smoother thus allowing the consumer to squeeze the liquid from the bag to taste. In the case of the bag shown in FIG. 2 for example, the pair of spot welds located near the midpoint of the lateral sides of the bag may offer some resistance, or even give way if quite lightly sealed, when the bag has when squeezed part-way. Reaching this intermediate point can be felt by the consumer as he or she pulls the ends of the drawstring apart.

Providing the constraining means or points can be achieved by art-known means such as attaching loosely fitted staples or providing spot or line welds or seals at the appropriate locations. The line welds may represent a portion of the length of the side it may run parallel to, or extend along substantially the entire length of that side. The constraining points or regions 7 may be arranged within the bag so that the drawstring traces a path along substantially the entire length of one or more sides, or they might provide an axis around which the drawstring may turn. Such axes may act as fulcrums and improve the effectiveness of the squeezing action. It can be desirable for such axes to be located adjacent the midpoint of the relevant side.

The constraining points and regions 7 can be complemented or supplemented by rigid attachment or anchoring points 7*a* which immovably fix the drawstring at some point that is preferably adjacent a side. This anchoring can be achieved by appropriate means well known in the art, for example by stapling, gluing and/or sealing the drawstring between the sides of the panels. We have found that it is generally preferable for the drawstring not to be anchored into the side(s) directly opposite the exit points 5*a* and 5*b* when such a margin or margins is or are formed by sealing two panels together. This is because the seal between the panels tends to give way when the drawstrings are pulled thus allowing the contents of the bag to flow from the bag.

The drawstring can be slidably constrained and/or anchored against at least two sides at more than one point or region thereof. The arrangement of those points or regions can be such that the portion of the drawstring within the bag traces a path alongside at least one side and/or the drawstring may cross-over itself within the interior of the bag. Where there is such a crossing-over pulling the drawstrings in generally opposite directions can be particularly effective to collapse the bag in order to force out liquid that remains in the bag after infusion. However similar of even better results can be achieved without this crossing-over.

The portion of the drawstring that is contained in the interior of the bag is preferably placed in position between the panels of the bag prior to sealing. This can be achieved using the technology disclosed in the specification of our UK patent application 9321034.2 (F7068). The contents of the specification of that application should be considered to be incorporated herein by way of reference.

The foregoing describes the invention and preferred forms thereof. However it should be appreciated that one skilled in the art would readily recognise that various modifications to the bags are possible and therefore it should be understood that the preferred embodiments described above have been presented solely for the purpose of providing a complete disclosure of the invention. The scope of the monopoly for which protection is sought is therefore defined solely by the following claims.

We claim:

1. A package containing a flowable infusible material comprising at least two panels of a porous material and at least three sides, said package having a drawstring that passes out of the interior of the package via a first exit point and a second exit point said drawstring having two ends outside of the interior of said package and two or more spot welds which constrain said drawstring adjacent to at least two of said sides, by independently sandwiching said drawstring between said spot welds and the adjacent side whereby pulling the ends of the drawstring in substantially opposite directions causes the drawstring to move relative to the sides it engages thus allowing the package to collapse.

2. A package according to claim 1, wherein the package has two panels, four sides and four vertices.

3. A package according to claim 2 wherein the first and second exit point are located adjacent the ends of a first side and the drawstring is constrained adjacent a second side that opposes the first side.

4. A package according to claim 3, wherein the drawstring is also constrained adjacent the remaining two sides.

5. A package according to claim 1, wherein the drawstring is constrained at a location adjacent the midpoint of said remaining two sides.

6. A package according to claim 1, wherein the package has two panels, three sides and three vertices.

7. A package according to claim 1, wherein the package has four panels, six sides and four vertices.

8. A package according to claim 1, wherein the package has two panels and an infinite number of sides thus defining a substantially circular or elliptical shape.

9. A package according to claim 1, wherein one or more pivot points are provided between either or both exit points and the constraining means to act as fulcrums when the ends of the drawstring are pulled in opposite directions.

10. A package according to claim 9, wherein a pivot point is located adjacent the midpoint of each of two sides.

* * * * *